US007070090B2

(12) United States Patent
Ranen

(10) Patent No.: US 7,070,090 B2
(45) Date of Patent: Jul. 4, 2006

(54) KIT AND METHOD FOR FIELD-MODIFICATION OF A MAILBOX TO PROTECT AGAINST MAIL THEFT

(76) Inventor: Howard Ranen, 18706 Lloyd Cir., Dallas, TX (US) 75252

( * ) Notice: Subject to any disclaimer, the term of this patent is extended or adjusted under 35 U.S.C. 154(b) by 9 days.

(21) Appl. No.: 10/955,822

(22) Filed: Sep. 30, 2004

(65) Prior Publication Data

US 2006/0065706 A1 Mar. 30, 2006

(51) Int. Cl.
*B65G 11/04* (2006.01)

(52) U.S. Cl. ..... 232/45; 232/17

(58) Field of Classification Search ..... 232/17, 232/45, 29, 33, 24

See application file for complete search history.

(56) References Cited

U.S. PATENT DOCUMENTS

| | | | | | |
|---|---|---|---|---|---|
| 755,038 | A * | 3/1904 | Palmer | 232/24 |
| 2,945,621 | A * | 7/1960 | Kopprasch et al. | 232/24 |
| 4,333,603 | A * | 6/1982 | Carlson | 232/17 |
| 4,361,271 | A * | 11/1982 | Hester et al. | 232/17 |
| 4,726,512 | A * | 2/1988 | White | 232/17 |
| 5,765,263 | A * | 6/1998 | Bolinas et al. | 16/342 |
| 5,915,618 | A * | 6/1999 | Gaudet | 232/33 |
| 6,808,108 | B1 * | 10/2004 | Turnbow et al. | 232/29 |
| 2004/0074957 | A1 * | 4/2004 | Devar | 232/17 |
| 2005/0258226 | A1 * | 11/2005 | Kujawa et al. | 232/17 |

* cited by examiner

*Primary Examiner*—William L. Miller
(74) *Attorney, Agent, or Firm*—Roger Burleigh

(57) ABSTRACT

A kit, and method of installation thereof, for field-modification of a mailbox to protect against mail theft. An exemplary kit includes: a security panel having a peripheral shape conforming to the interior dimensions of an opening defined by walls of the mailbox and a slot suitable for mail pieces to be inserted through the security panel, wherein the opening provides full access to the interior of the mailbox when a hinged door is moved from a closed position to an open position; a hinge piece having a first portion adapted to be secured to a wall of the mailbox proximate to the opening and a second portion adapted to be hingedly coupled to a first edge of the security panel, whereby the security panel provides full access to the interior of the mailbox when moved from a closed position to an open position; a first lock member coupled to the security panel; and, a second lock member having a first portion adapted to be secured to a wall of the mailbox proximate to the opening and a second portion adapted to interlock with the first lock member, whereby the security panel can be locked when moved from an open position to a closed position.

18 Claims, 3 Drawing Sheets

KIT AND METHOD FOR FIELD-MODIFICATION OF A MAILBOX TO PROTECT AGAINST MAIL THEFT

TECHNICAL FIELD OF THE INVENTION

The present invention is directed, in general, to mailboxes and, more specifically, to modification of mailboxes to protect against mail theft.

BACKGROUND OF THE INVENTION

Identity theft occurs when someone uses another person's name, address, Social Security number (SSN), bank or credit card account number, or other identifying information without to commit fraud or other crimes. Identity thieves use a variety of low-and high-tech methods to gain access to personally identifying information. One of the easiest methods of such criminals is to steal mail, such as bank and credit card statements, pre-approved credit offers, new checks, or tax information, from residential mailboxes.

To protect against residential mail theft, some mailboxes are provided with a slot that is sufficient to allow a delivery person to slide mail items into the box, yet too small to allow a human hand to reach into the box to remove mail items. Such mailboxes include a lockable door that provides access to the owner to remove the mail items.

In the prior art, lockable mailboxes typically have been constructed with the locking features integrally-formed with the mailbox by the manufacturer. If a homeowner wishes to replace a non-locking mailbox with a lockable mailbox, he must purchase and install a complete mailbox. In some residential neighborhoods, however, it has become common for mailboxes to be permanently installed within brick enclosures and, thus, it is quite difficult to replace a mailbox without significant time and effort.

Accordingly, there is need in the art for kits, and methods of installation thereof, for field-modification of a mailbox to protect against mail theft. Such kits are preferably adapted for easy installation by an owner of an existing non-secure mailbox.

SUMMARY OF THE INVENTION

To address the above-discussed deficiencies of the prior art, the present invention relates to kits, and methods of installation thereof, for field-modification of a mailbox to protect against mail theft. An exemplary kit includes: a security panel having a peripheral shape conforming to the interior dimensions of an opening defined by walls of the mailbox and a slot suitable for mail pieces to be inserted through the security panel, wherein the opening provides full access to the interior of the mailbox when a hinged door is moved from a closed position to an open position; a hinge piece having a first portion adapted to be secured to a wall of the mailbox proximate to the opening and a second portion adapted to be hingedly coupled to a first edge of the security panel, whereby the security panel provides full access to the interior of the mailbox when moved from a closed position to an open position; a first lock member coupled to the security panel at a second edge opposite to the first edge of the security panel; and, a second lock member having a first portion adapted to be secured to a wall of the mailbox proximate to the opening and opposite to the location of the hinge piece and a second portion adapted to interlock with the first lock member, whereby the security panel can be locked when moved from an open position to a closed position.

In an exemplary embodiment, the kit is adapted for installation in a mailbox of a conventional pole-mounted design, having a flat bottom wall with first and second parallel edges perpendicular to the mailbox opening and a single U-shaped wall extending from the first and second parallel edges of the flat bottom wall. Alternative kits, based on the principles of the invention, can be adapted for installation in mailboxes having different shapes.

In an exemplary embodiment, the hinge piece and second locking member are secured to the walls of the mailbox using double-sided adhesive tape, which allows the kit to be easily installed in an existing mailbox, particularly those mounted within brick enclosures. In an alternate embodiment, the kit is installed using screws.

The foregoing has outlined, rather broadly, the principles of the present invention so that those skilled in the art may better understand the detailed description of the exemplary embodiments that follow. Those skilled in the art should appreciate that the disclosed conception and exemplary embodiments can be used as a basis for designing or modifying other structures and methods for carrying out the same purposes of the present invention, and that such equivalent constructions do not depart from the spirit and scope of the invention in its broadest form, except as specifically limited by the claims recited hereinafter.

BRIEF DESCRIPTION OF THE DRAWINGS

For a more complete understanding of the present invention, reference is now made to the following detailed description taken in conjunction with the accompanying drawings, in which.

DETAILED DESCRIPTION

Figure 1:
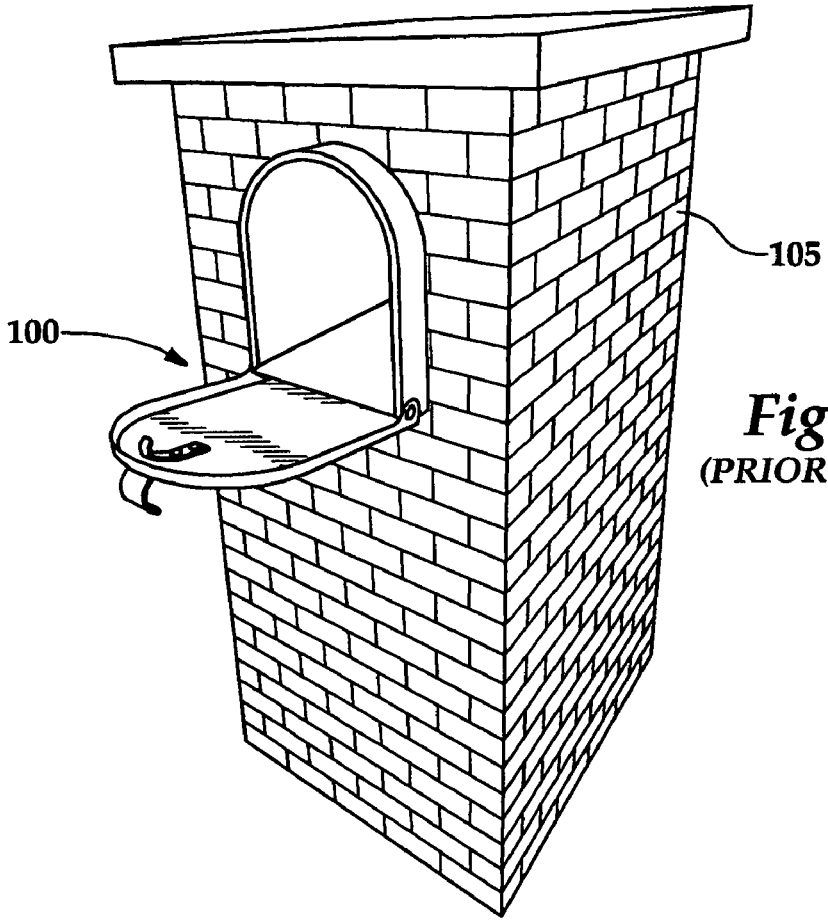
Fig.1 (PRIOR ART)
FIG. 1 illustrates a prior art mailbox.

FIG. 1 illustrates a prior art mailbox 100. The mailbox 100 is a non-locking mailbox, and is mounted in a brick enclosure commonly installed by new home builders. If a homeowner wishes to replace the mailbox 100 with a lockable mailbox, he must purchase and install a complete mailbox, which would be difficult to accomplish without significant time and effort. To overcome the need in the prior art for complete replacement of mailbox 100, the present invention provides kits, and methods of installation thereof, for field-modification of mailbox 100 to protect against mail theft.

Figure 2:
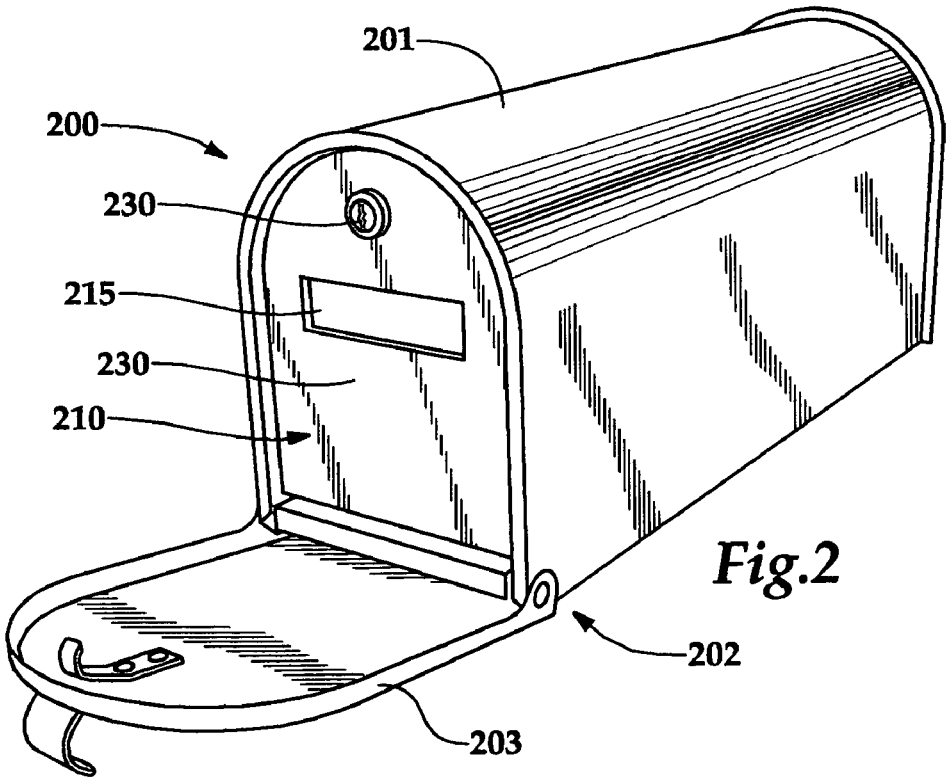
FIG. 2 illustrates a first view of a mailbox having a security door in accordance with the principles of the invention.

FIG. 2 illustrates a first view of an exemplary mailbox 200 having a security panel 210 in accordance with the principles of the invention. The exemplary mailbox 200 is identical to mailbox 100 and requires no modifications or removal from a fixture on or in which it is mounted (such as brick enclosure 105). As illustrated in FIG. 2, the security panel 210 is adapted for installation in a mailbox 200 of a conventional pole-mounted design, having a flat bottom wall 202 (hidden) with first and second parallel edges perpendicular to the mailbox opening and a single U-shaped wall 201 extending from the first and second parallel edges of the flat bottom wall. Alternative kits, based on the principles of the invention, can be adapted for installation in mailboxes having different shapes. The exemplary security panel 210 has a peripheral shape conforming to the interior dimensions of an opening defined by the sidewalls 201, 202 of the mailbox 200, wherein the opening provides full access to the interior of the mailbox when a hinged door 220 is moved from a closed position to an open position. The security panel 210 further includes a slot 215 suitable for mail pieces to be inserted through the security panel and a lock 230 to secure the panel. In the exemplary embodiment, lock 230 is a conventional cam lock, such as Part Number RA709-CHR-KA available from Outwater Plastics Industries, Inc., Wood-Ridge, N.J. The mailbox 200 also includes a hinged door 203 which can be closed to seal the mailbox and prevent rain from entering through the slot 215 in security panel 210.

Figure 3:
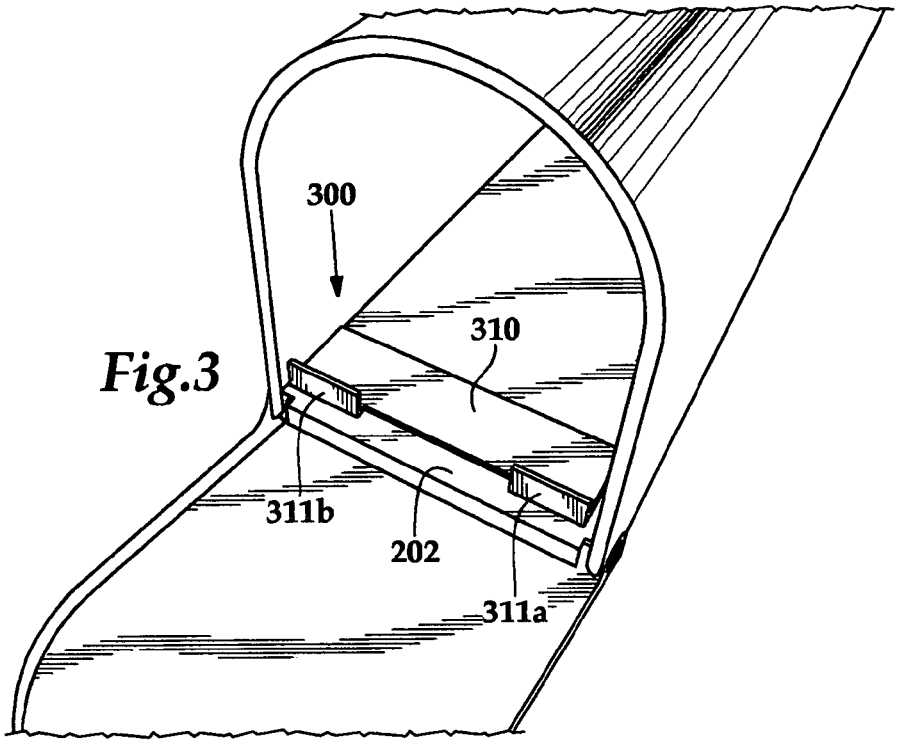
FIG. 3 illustrates the mounting of an exemplary hinge piece for the security door in a mailbox.
Figure 4:
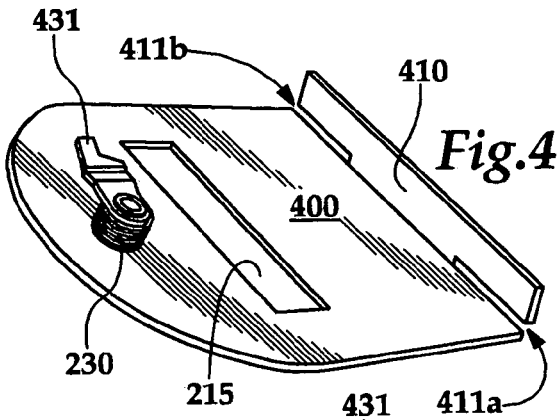
FIG. 4 illustrates an exemplary embodiment of the security door.
Figure 5:
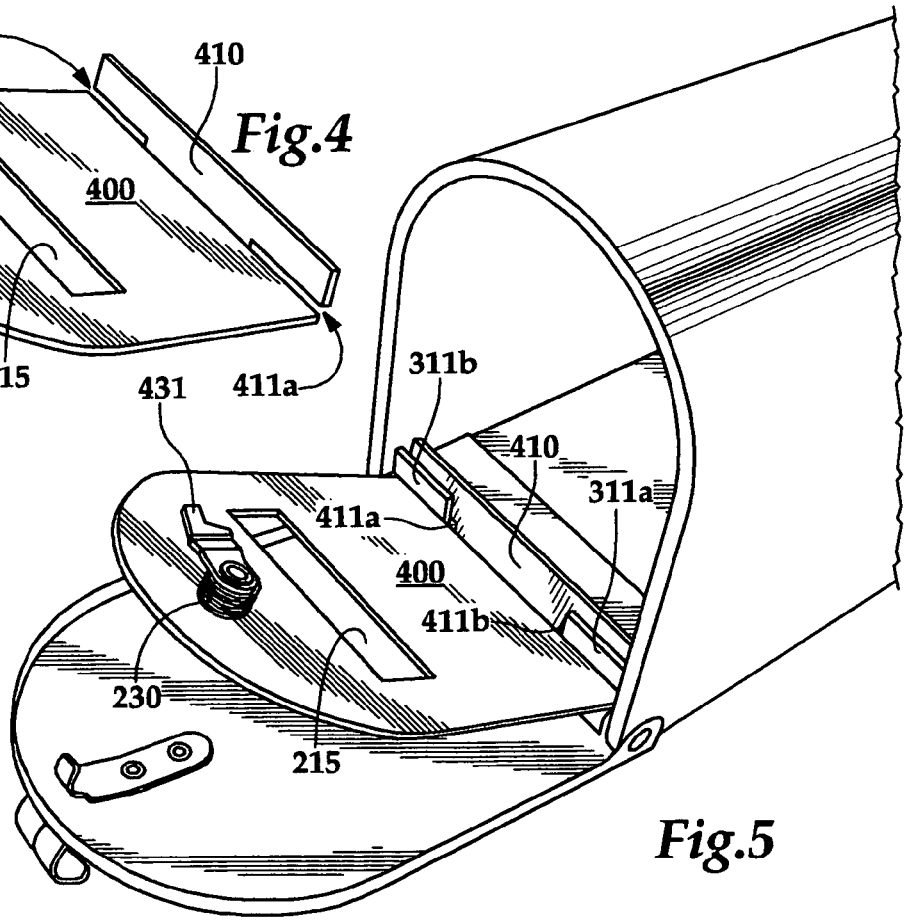
FIG. 5 illustrates the mounting of the exemplary security door illustrated in FIG. 4 on the exemplary hinge piece illustrated in FIG. 3.
Figure 6:
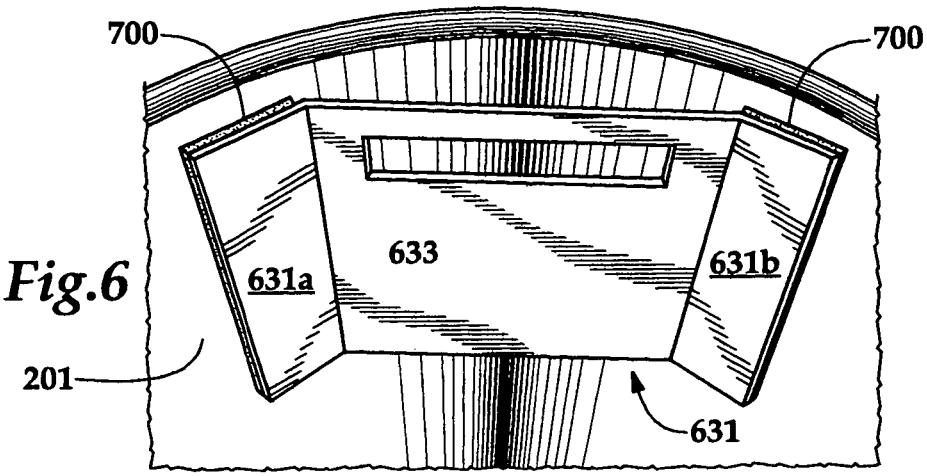
FIG. 6 illustrates the mounting of an exemplary lock member for the security door in a mailbox.

Turning now to FIG. 3, illustrated is the mounting of a hinge piece 300 for an exemplary security panel. The hinge piece 300 has a first portion 310 adapted to be secured to the bottom wall 202 of the mailbox proximate to the mailbox opening, and a second portion, comprising tabs 311-A and 311-B, adapted to be hingedly coupled to a first edge of the security panel 210. The hinge piece 300 is adapted to form a simple hinge in combination with the exemplary door 400 illustrated in FIG. 4. The door 400 has, along a bottom edge, a lip 410 extending substantially perpendicular to the front surface of the door. Proximate to the intersection of the lip 410 and front surface of the door 400 are provided slots 411-A and 411-B adapted to interlock with tabs 311-A and 311-B, respectively; when interlocked, as illustrated in FIG. 5, the door 400 is operative to rotate between an open position and a closed position. In the closed position, a tongue 431 of lock 230 can secure the door by interlocking with a lock member 631 (see FIG. 6) secured to the interior of wall 201 of mailbox 201. As illustrated in FIG. 6, lock member 631 has a first portion, comprising flanges 632-A and 632-B, adapted to be secured to the interior of wall 201 of the mailbox 200 proximate to the opening and opposite to the location of the hinge piece 300, and a second portion, comprising a slot 633 adapted to interlock with the tongue 431 of lock 230.

Figure 7:
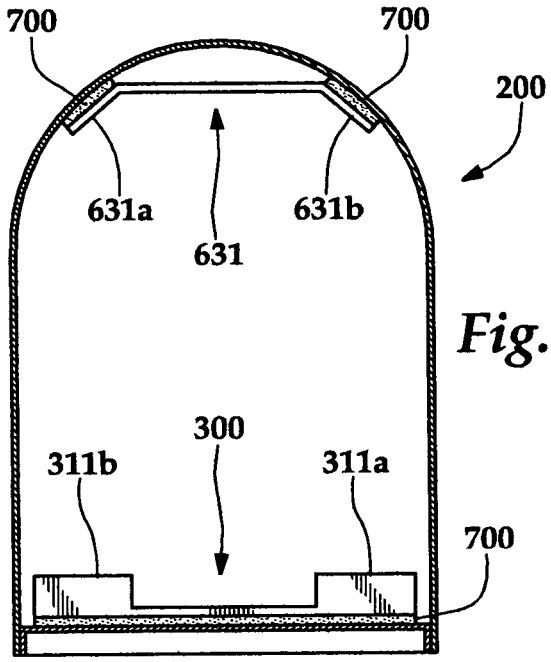
FIG. 7 illustrates a front view of the mailbox showing the mounting of the exemplary hinge piece and the lock member.

Turning now to FIG. 7, illustrated is a front view of the exemplary mailbox 200 showing the mounting of the exemplary hinge piece 300 and the exemplary lock member 631. In the embodiment illustrated, the hinge piece 300 and lock member 631 are secured to the walls of the mailbox using double-sided adhesive tape, generally designated 700, which allows the kit to be easily installed in an existing mailbox, particularly one mounted within a brick enclosure; in alternate embodiments, the kit can be installed using, for example, self-taping sheet metal screws. There are many commercially-available double-sided adhesive tapes suitable for securely fastening the hinge piece 300 and lock member 631 to the interior walls of mailbox 200, such as Automotive Acrylic Plus Attachment Tape available from 3M, St. Paul, Minn.

Figure 8:
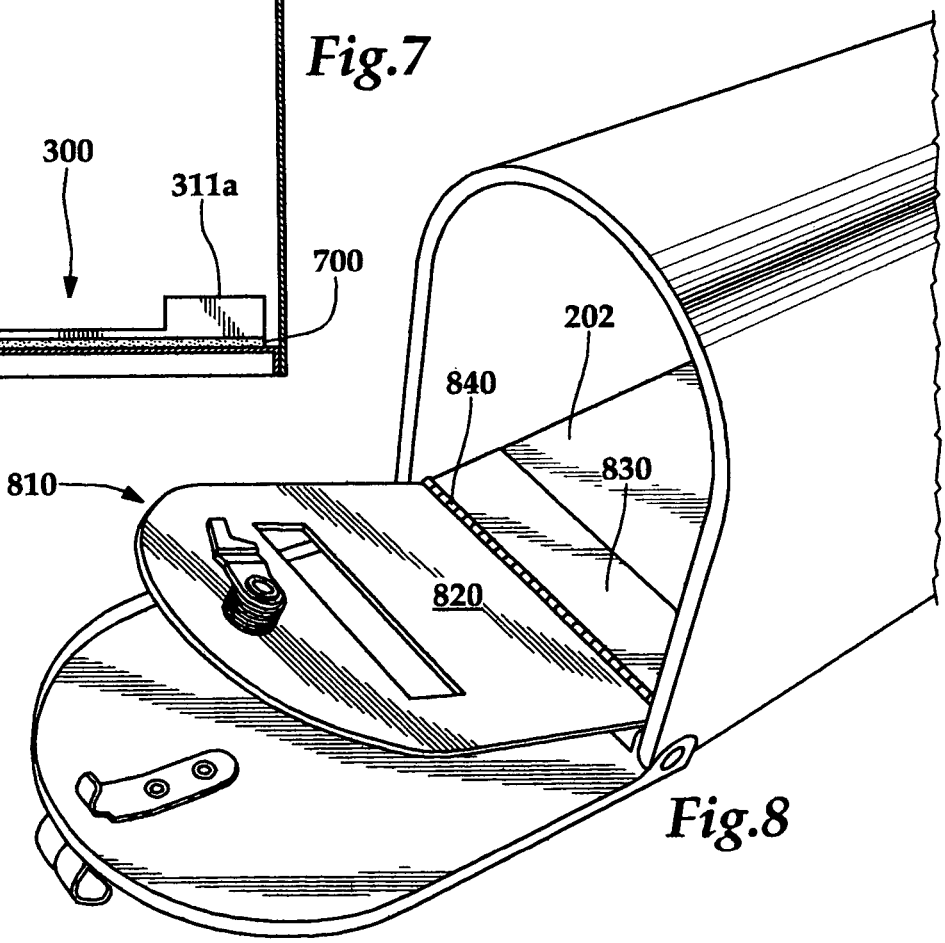
FIG. 8 illustrates a second exemplary embodiment of the security door.

Finally, FIG. 8 illustrates a second exemplary embodiment of a security panel 810. The security panel 810 integrates, using a piano hinge 840, a door 820 with a hinge piece 830 that is secured to the bottom wall 202 of the mailbox proximate to the mailbox opening. The piano hinge 840 substitutes for the slots 411-A and 411-B in door 400 adapted to interlock with tabs 311-A and 311-B, respectively, in hinge member 300, as illustrated in FIGS. 3–5.

From the foregoing, those skilled in the art will recognize that the present invention provides significant advantages to the field of mailboxes; in particular, providing kits, and methods of installation thereof, for field-modification of a mailbox to protect against mail theft. Although the present invention has been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the form disclosed; it is intended that the scope of the invention be defined by the claims appended hereto, and their equivalents.

What is claimed is:

1. A kit for field-modification of a mailbox to protect against mail theft, wherein said mailbox comprises walls that define an opening at an end of said mailbox, wherein a hinged door is affixed to said mailbox proximate to said opening, said opening providing full access to the interior of said mailbox when said hinged door is moved from a closed position to an open position, said kit comprising:

a security panel having a peripheral shape conforming to the interior dimensions of said opening defined by said walls and a slot suitable for mail pieces to be inserted through said security panel;

a hinge piece having a first portion adapted to be secured to one of said walls of said mailbox proximate to said opening and a second portion adapted to be hingedly coupled to a first edge of said security panel, whereby said security panel provides full access to the interior of said mailbox when said security panel is moved from a closed position to an open position;

at least one first coupler for securing said first portion of said hinge piece to said one of said walls of said mailbox;

a first lock member coupled to said security panel at a second edge opposite to said first edge of said security panel; and, a second lock member having a first portion adapted to be secured to another of said walls of said mailbox proximate to said opening and a second portion adapted to interlock with said first lock member whereby said security panel can be locked when said security panel is moved from said open position to said closed position; and at least one second coupler for securing said second lock member to said another of said walls of said mailbox;

wherein, when said kit is installed in said mailbox, a secure region for receiving deposited mail articles is substantially bounded by said security panel and said walls of said mailbox rearward of said panel, thereby allowing substantially the full volume of said mailbox behind said security panel to hold said deposited mail articles.

2. The kit recited in claim 1, wherein one of said walls of said mailbox comprises a flat bottom wall having first and second parallel edges perpendicular to said opening and said another of said walls of said mailbox comprises a single U-shaped wall extending from said first and second parallel edges of said flat bottom wall.

3. The kit recited in claim 2, wherein said first portion of said hinge piece is secured to said flat bottom wall.

4. The kit recited in claim 2, wherein said first portion of said second lock member is secured to said U-shaped wall.

5. The kit recited in claim 1, wherein said first and second couplers comprise double sided adhesive tape.

6. The kit recited in claim 1, wherein said first lock member comprises a keyed cam lock.

7. The kit recited in claim 6, wherein said second portion of said second lock member adapted to interlock with said first lock member comprises a slot for receiving a tongue of said cam lock when said cam lock is rotated to a locked position.

8. The kit recited in claim 1, wherein said second portion of said hinge piece adapted to be hingedly coupled to a first edge of said security panel comprises a piano hinge.

9. The kit recited in claim 1, wherein said security panel comprises aluminum.

10. A method for field-modification of a mailbox to protect against mail theft, wherein said mailbox comprises walls that define an opening at an end of said mailbox, wherein a hinged door is affixed to said mailbox proximate to said opening, said opening providing full access to the interior of said mailbox when said hinged door is moved from a closed position to an open position, said method comprising the steps of:

securing a first portion of a hinge piece to one of said walls within said mailbox proximate to said opening;

securing a first portion of a first lock member to another of said walls within said mailbox proximate to said opening;

coupling a first edge of a security panel to a second portion of said hinge piece, said security panel having a peripheral shape conforming to the interior dimensions of said opening defined by said walls and a slot suitable for mail pieces to be inserted through said security panel, said security panel providing full access to the interior of said mailbox when said security panel is moved from a closed position to an open position, said security panel having a second lock member coupled to said security panel, said first lock member having a second portion adapted to interlock with said second lock member whereby said security panel can be locked when said security panel is moved from said open position to said closed position;

wherein, a secure region for receiving deposited mail articles is substantially bounded by said security panel and said walls of said mailbox rearward of said panel, thereby allowing substantially the full volume of said mailbox behind said security panel to hold said deposited mail articles.

11. The method recited in claim 10, wherein said one of said walls of said mailbox comprises a flat bottom wall having first and second parallel edges perpendicular to said opening and said another of said walls of said mailbox comprises a single U-shaped wall extending from said first and second parallel edges of said flat bottom wall.

12. The method recited in claim 11, wherein said first portion of said hinge piece is secured to said flat bottom wall.

13. The method recited in claim 11, wherein said first portion of said first lock member is secured to said U-shaped wall.

14. The method recited in claim 10, wherein said steps of securing said first portion of said hinge piece and said first portion of said first lock member to said walls within said mailbox comprises the step of fixedly joining said pieces with couplers.

15. The method recited in claim 14, wherein said couplers comprise double-sided adhesive tape.

16. The method recited in claim 10, wherein said second lock member comprises a keyed cam lock.

17. The method recited in claim 16, wherein said second portion of said first lock member adapted to interlock with said second lock member comprises a slot for receiving a tongue of said cam lock when said cam lock is rotated to a locked position.

18. The method recited in claim 10, wherein said second portion of said hinge piece adapted to be hingedly coupled to said first edge of said security panel comprises a piano hinge.

* * * * *